US009233417B2

(12) United States Patent
Erhard et al.

(10) Patent No.: US 9,233,417 B2
(45) Date of Patent: Jan. 12, 2016

(54) CASTING UNIT FOR A DIECASTING MACHINE

(75) Inventors: Norbert Erhard, Lorch (DE); Helmar Dannenmann, Schorndorf (DE); Juergen Kurz, Pluederhausen (DE); Andreas Sydlo, Schorndorf (DE); Daniel Gerner, Moegglingen (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 337 days.

(21) Appl. No.: 13/512,544

(22) PCT Filed: Nov. 24, 2010

(86) PCT No.: PCT/EP2010/068123

§ 371 (c)(1),
(2), (4) Date: Jul. 17, 2012

(87) PCT Pub. No.: WO2011/064253

PCT Pub. Date: Jun. 3, 2011

(65) Prior Publication Data

US 2012/0273530 A1 Nov. 1, 2012

(30) Foreign Application Priority Data

Nov. 30, 2009 (DE) ..... 10 2009 057 197

(51) Int. Cl.
*B22D 17/22* (2006.01)
*B22D 17/02* (2006.01)
(Continued)

(52) U.S. Cl.
CPC ..... *B22D 17/02* (2013.01); *B22D 17/04* (2013.01); *B22D 17/08* (2013.01); *B22D 17/203* (2013.01); *B22D 17/2023* (2013.01); *B22D 17/2038* (2013.01)

(58) Field of Classification Search
CPC ..... B22D 17/02; B22D 17/04; B22D 17/2038
USPC ..... 222/591, 590, 594; 164/316
See application file for complete search history.

(56) References Cited

U.S. PATENT DOCUMENTS 3,447,593 A * 6/1969 Nyselius ..... 164/312
3,814,170 A 6/1974 Kahn
(Continued)

FOREIGN PATENT DOCUMENTS

CN 1373695 A 10/2002
CN 1449315 A 10/2003
(Continued)

OTHER PUBLICATIONS

Japanese Office Action dated Sep. 2, 2014 with English translation (five (5) pages).
(Continued)

*Primary Examiner* — Scott Kastler
(74) *Attorney, Agent, or Firm* — Crowell & Moring LLP

(57) ABSTRACT

A diecasting machine casting unit includes a casting chamber body having a casting chamber with a casting material inlet and outlet. A casting piston is movable forward in a longitudinal direction in the casting chamber to discharge casting material from the casting chamber under pressure via the outlet, and is movable back, whereby casting material is feedable into the casting chamber via the inlet. The casting piston extends through a through-passage of the casting chamber body from outside into the casting chamber. An area of free space of the casting chamber is formed between an outer lateral surface of the casting piston and an inner wall surface of the casting chamber body transversely relative to the casting piston longitudinal direction by an outer cross section of the casting piston being appropriately smaller than an inner cross section of the casting chamber body.

20 Claims, 5 Drawing Sheets

(51) Int. Cl.

| | |
|---|---|
| ***B22D 17/04*** | (2006.01) |
| ***B22D 17/08*** | (2006.01) |
| ***B22D 17/20*** | (2006.01) |

(56) References Cited

U.S. PATENT DOCUMENTS

| | | | | |
|---|---|---|---|---|
| 5,448,678 | A * | 9/1995 | Booton et al. | 392/480 |
| 5,472,039 | A | 12/1995 | Schwab | |
| 6,745,821 | B1 | 6/2004 | Wilson | |
| 7,234,505 | B2 | 6/2007 | Murray et al. | |
| 7,810,550 | B2 | 10/2010 | Erhard et al. | |
| 2003/0079854 | A1 | 5/2003 | Flemings et al. | |
| 2008/0277088 | A1 | 11/2008 | Fritsche et al. | |
| 2009/0000758 | A1 * | 1/2009 | Stone et al. | 164/316 |
| 2012/0273530 | A1 * | 11/2012 | Erhard et al. | 222/591 |

FOREIGN PATENT DOCUMENTS

| | | | |
|---|---|---|---|
| CN | 101077520 | A | 11/2007 |
| DE | 32 48 423 | A1 | 6/1984 |
| DE | 43 16 927 | A1 | 11/1994 |
| DE | 195 44 716 | A1 | 6/1997 |
| DE | 10 2005 009 669 | A1 | 8/2006 |
| EP | 0 114 934 | A1 | 8/1984 |
| EP | 0 576 406 | A2 | 12/1993 |
| EP | 1 483 074 | B1 | 6/2007 |
| JP | 5-24147 | A | 3/1993 |
| JP | 10-15652 | A | 1/1998 |
| JP | 11-156521 | A | 6/1999 |
| JP | 2002-534272 | A | 10/2002 |
| JP | 2004-243366 | A | 9/2004 |
| JP | 2009-116054 | A | 5/2009 |
| JP | 2009-148796 | A | 7/2009 |
| JP | 2009-166054 | A | 7/2009 |
| JP | 2011-110566 | A | 6/2011 |
| SU | 1126363 | A | 6/1983 |
| WO | WO 03/074211 | A2 | 9/2003 |

OTHER PUBLICATIONS

German Office Action dated Jul. 30, 2010 (Two (2) pages).
International Search Report dated Mar. 24, 2011 including English-language translation (Four (4) pages).
International Preliminary Report on Patentability dated Jun. 14, 2012 (eight (8) pages).

* cited by examiner

CASTING UNIT FOR A DIECASTING MACHINE

BACKGROUND AND SUMMARY OF THE INVENTION

The invention relates to a casting unit for use in a diecasting machine, the casting unit comprising a casting chamber body and a casting piston. The casting chamber body has a casting chamber which can be filled with casting material and has a casting material inlet and a casting material outlet. The casting piston can be moved forward in a longitudinal direction of the casting piston in the casting chamber, in order to discharge casting material from the casting chamber under pressure via the casting material outlet, and can be moved back, whereby casting material can be fed into the casting chamber via the casting material inlet.

Such casting units typically serve for conveying a molten metal at high speed and high pressure out of the casting chamber into a die cavity by the action of the casting piston in the corresponding diecasting machines, for example of the hot-chamber or cold-chamber type. In the die cavity, the desired metal casting then forms by the molten metal solidifying. Depending on the casting material, for example alloys of zinc, Al or magnesium, and the casting to be produced, the casting unit has to withstand relatively high temperatures and pressures of the molten metal, for example over 600° C. and 1000 bar, which is known to require special structural design measures.

In the case of conventional casting units, the casting piston is typically formed as a spool, which can be moved axially forward and back in a hollow-cylindrical casting chamber body, its outer cross section corresponding to the inner cross section of the casting chamber body. In other words, this spool forms an axially movable end wall of the casting chamber that variably delimits the casting chamber volume, this conventional type of casting piston sealing the casting chamber volume off at this end face by its outer cross section corresponding to the inner cross section of the casting chamber body, possibly assisted by assigned sealing devices that are arranged for example on the outer circumference of the piston. The force transmission to the casting piston takes place via a piston shaft that is provided on the extreme end of the casting piston facing away from the casting chamber and has a cross section smaller than that of the casting piston. The casting piston shaft may for example be led through an associated through-passage in the casting chamber body out of the latter, this through-passage then having a cross section which corresponds to that of the piston shaft and is smaller than the outer cross section of the casting piston and the inner cross section of the cylindrical casting chamber body.

Various conventional casting units are disclosed for example in the laid-open patent applications DE 10 2005 009 669 A1, DE 195 44 716 A1 and DE 43 16 927 A1 and also in the patent specification EP 1 483 074 B1.

Casting units with said type of spool present some specific technological challenges. One problematic aspect is the effect of so-called skin solidifying. The comparatively cooler cylinder wall of the casting chamber body may cause molten material to harden on its inner wall and disturb or hinder the movement of the casting piston moving in a sealing manner along it with two-dimensional area contact. Moreover, with the casting piston moved back, in the casting chamber there is not only casting material but usually also air, which has to be driven out again during the die-filling operation, i.e. when moving the casting piston forward, or may lead to problems of the molten material oxidizing.

It is an object of the invention to provide a casting unit for a diecasting machine with which the aforementioned difficulties of conventional casting units of the spool type can be eliminated or at least reduced.

The invention achieves this object by providing a casting unit comprising a casting chamber body and a casting piston, where the casting chamber body includes a casting chamber which can be filled with cating material and has a casting material inlet and a cating material outlet. The casting piston is capable of being moved forward in a longitudinal direction of the casting piston in the casting chamber, in order to discharge casting material from the casting chamber under pressure via the casting material outlet, and moved backward, in order to feed casting material into the casting chamber via the casting material inlet. The casting piston extends through a through-passage of the casting chamber body from outside into the casting chamber, an area of free space of the casting chamber being formed between an outer lateral surface of the casting piston moved forward into the casting chamber and an inner wall surface of the casting chamber body lying opposite said outer lateral surface transversely in relation to the longitudinal direction of the casting piston, by an outer cross section of the casting piston being appropriately smaller than an inner cross section of the casting chamber body.

In other words, in the case of the casting unit according to the invention, the casting piston is of a displacement type, which reduces the casting chamber volume appropriately by moving forward into the casting chamber, without coming to lie with its outer cross section against the inner cross section of the casting chamber body in a sealing manner over its entire surface area like a conventional spool. Leaving the area of free space does away with any problems of friction between the outer cross section of the casting piston and the inner cross section of the casting chamber body lying opposite transversely in relation to the longitudinal direction of the casting piston, for example as a result of the mentioned effect of the skin solidifying. Thus, any problem of friction caused by two-dimensional, surface-area frictional contact can be limited locally to the region of the through-passage. This can be controlled much more easily than the conventional problem of friction between the outer cross-sectional area of the casting piston and the inner cross-sectional area of the casting chamber body along the entire length of displacement in the case of the conventional type of spool. If need be, an only one-dimensional, linear or zero-dimensional, punctiform guiding contact may be retained between the casting piston and the casting chamber delimiting wall. Furthermore, this design of the casting unit according to the invention is a comparatively easy way of offering the possibility of keeping the casting chamber completely filled with casting material at all times, without ambient air inevitably getting into the casting chamber.

In a development of the invention, the casting material inlet opens out into the area of free space and/or into the casting material outlet of the casting chamber. This advantageously has the consequence that, even with the casting piston moved forward to the maximum, the casting chamber inlet is not blocked by the latter. Thus, even at the beginning of the movement back of the casting piston from its position of having been moved forward to the maximum, casting material can already be fed into the casting chamber via the casting inlet. By contrast with this, in the case of conventional casting units of the spool type, the casting inlet is usually blocked by the casting piston that has been moved forward and is only released by it when the casting piston has moved back a certain amount from its position of having been moved forward to the maximum. The present casting unit consequently makes a comparatively uniform, homogeneous feeding of casting material into the casting chamber possible, and consequently also the avoidance of undesired turbulences and undesired sucking in of ambient air via the casting material outlet when the casting piston is moved back. The casting chamber can consequently be readily kept completely filled with casting material at all times.

In a further refinement, the casting material inlet and/or a casting material feed line assigned to it is provided with a shut-off element, which prevents casting material from leaving the casting chamber via the casting material inlet. Depending on requirements and the application, this may be an actively or passively acting shut-off element of a conventional type known per se, for example an appropriate check valve.

In a development of the invention, the casting chamber body has a hollow cylinder, and the through-passage is provided at an extreme end of the same. The casting piston may then for example extend with the longitudinal axis of the piston that is parallel to the longitudinal axis of the hollow cylinder axially via the through-passage into the casting chamber. In a further refinement, the casting material outlet and/or the casting material inlet is provided at the extreme end of the hollow cylinder that is opposite from the through-passage or on the cylinder lateral surface of the hollow cylinder. These positioning measures may contribute to favorable flow characteristics for the casting material that is to be introduced into the casting chamber and casting material that can be discharged from it under pressure into a die cavity.

In a development of the invention, a guiding sleeve is provided for the casting piston, said sleeve extending outward from an outer side of the through-passage that is facing away from the casting chamber and/or extending from an inner side of the through-passage that is facing the casting chamber into the casting chamber. With this guiding sleeve, the casting piston may be additionally supported and guided during its movement forward and back.

In a development of the invention, a sealing element for sealing off the casting piston passage is provided. In one possible way of realizing this, the sealing element is arranged on an inner side of the through-passage or of the guiding sleeve that is facing the casting chamber. Arranging it on the inner side has the advantage that, should a solidifying effect occur in this region, solidified molten material can be forced back into the casting chamber without any problem when the casting piston moves forward, without causing disturbing frictional effects between the casting piston and the inner wall of the casting chamber body. Also when the casting piston moves back, molten material that has possibly solidified on the inner side of the through-passage or the guiding sleeve in the region of the sealing element does not cause any problems, if only because, by contrast with the movement forward of the casting piston, this movement back can take place with virtually no pressure. This is so because, during the movement back of the casting piston, the casting material in the casting chamber is not under the high pressure such as that prevailing during the die-filling phase when the casting piston is moving forward, but is pressureless or at most under a much lower feed pressure, which may optionally be used for replenishing the casting chamber with casting material.

In a development of the invention, a casting piston temperature control device for actively controlling the temperature of the casting piston, at least in certain regions, is provided. It is thereby possible, according to requirements and the application, to have an active influence on the temperature of the casting piston, the part of which that is respectively in the casting chamber being subjected to the effects of the temperature of the hot casting material that is present there. In a refinement of this measure, the casting piston temperature control device is designed for allowing the temperature of the casting piston to be actively controlled according to a predeterminable temperature profile along at least part of its length. For example, this may involve suitably compensating partly or completely for a temperature influence of the hot casting material in the casting chamber on the casting piston that leads to a temperature gradient along the casting piston.

In a development of the invention, a casting chamber temperature control device for actively controlling the temperature of the casting chamber is provided. This may be used for example for preventing effects of molten material solidifying in the casting chamber or for achieving a relatively homogeneous temperature distribution of the casting material in the casting chamber.

In a development of the invention, the casting unit has a relieving annular groove and a relieving channel, the relieving annular groove being located on an inner wall of the through-passage or the guiding sleeve that is facing the casting piston and the relieving channel being led from the relieving annular groove to the outer side of the casting chamber body. If some molten material or other fluid gets between the casting piston and the through-passage or guiding sleeve, for example owing to wear, it can be led away to the outside in a controlled manner via the relieving annular groove and the relieving channel.

BRIEF DESCRIPTION OF THE DRAWINGS

Advantageous embodiments of the invention are described below and represented in the drawings, in which.

DETAILED DESCRIPTION OF THE DRAWINGS

Figure 1:
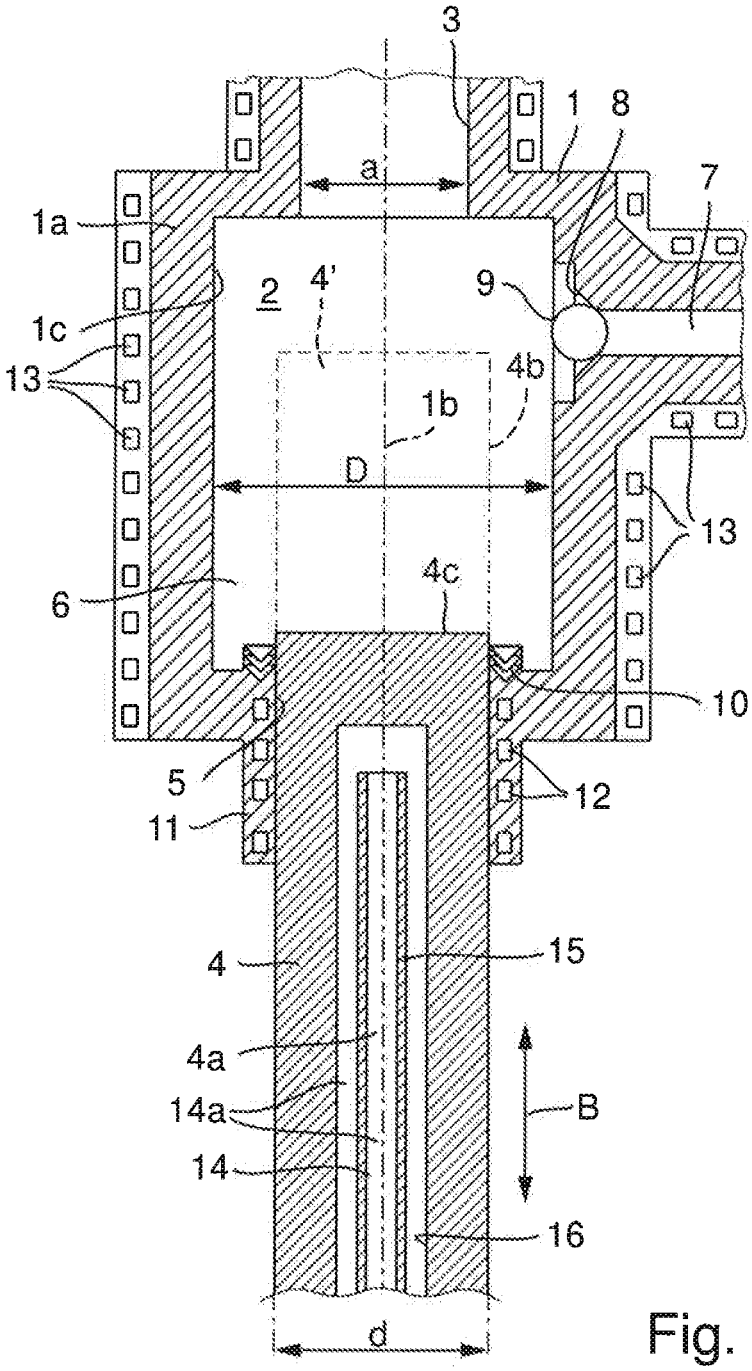
FIG. 1 shows a casting unit for a diecasting machine in a schematic side view.

The casting unit schematically represented in FIG. 1 is suitable in particular for processing liquid and partially liquid molten metals, such as alloys of tin, zinc, lead, aluminum, magnesium, titanium, steel or copper or a number of these metals, mixtures of a number of metals and optionally such materials with admixtures of particles, in an associated diecasting machine. The casting unit may, depending on requirements and in particular depending on the type of diecasting machine, be fitted into the casting machine concerned for example as a so-called vertical or horizontal casting unit. The casting unit has a casting chamber body 1, which in the example shown comprises a hollow cylinder 1*a*, which with its interior forms a casting chamber 2. Provided at an end face on the top in FIG. 1 is a casting material outlet 3, via which casting material can be conveyed out of the casting chamber 2 in a conventional way (not shown any further here)

into a die cavity, which is formed in the usual way by a fixed die half and a movable die half of the diecasting machine and defines the contour of a casting to be produced.

Furthermore, the casting unit comprises a casting piston 4, which is realized as an elongate displacement piston and extends through a through-passage 5 of the casting chamber body 1 from outside into the casting chamber 2. In the example shown, the through-passage 5 is provided at the end face of the hollow-cylindrical casting chamber body 1 that is opposite from the casting material outlet 3, to be precise in a way similar to the casting material outlet 3 centrally in relation to a longitudinal axis 1*b* of the hollow cylinder 1 of the casting chamber. The casting chamber 4 is held such that it can be moved axially back and forth with the longitudinal axis 4*a* in line with the longitudinal axis 1*b* of the hollow cylinder, as symbolized by a double-headed movement arrow B, it being shown in FIG. 1 in a rearward end position.

The casting piston 4 has an outer diameter d, which at least over a part of the casting piston 4 that can be moved into the casting chamber 2 or through the through-passage 5 is constant and corresponds substantially to the diameter of the through-passage 5. This part of the casting piston 4 may optionally also have a slightly conical form, an adapted sealing having to be provided in this case. In comparison, the hollow cylinder 1*a* of the casting chamber has a larger inner diameter D, i.e. D>d, so that between the portion of the casting piston that has been moved forward into the casting chamber and the radially opposing casting chamber wall there remains an annular gap 6 as an area of free space of the casting chamber, which permanently forms part of the casting chamber volume since it is not shut off by the casting piston. In other words, in an advanced casting piston position 4' that is indicated by dashed lines in FIG. 1, an outer lateral surface 4*b* of the casting piston 4 and an inner wall surface 1*c* of the hollow-cylindrical casting chamber body 1 lie opposite each other with a radial free-space distance $$\frac{D-d}{2},$$

the annular gap 6 of the free space formed in this way being permanently filled during operation with the casting material that is located in the casting chamber 2. It goes without saying that the casting piston 4 may have in its rear portion, that is not able to be moved into the casting chamber 2, any desired cross-sectional configuration, for example a stepped or conical form.

In the rear piston end position shown, an extreme end 4*c* of the casting piston 4 that is on the casting chamber side is at a small distance from the through-passage 5 in the casting chamber 2. From this rear end position, the casting piston 4 can in each case be moved forward to such an extent that the desired amount of liquid or partially liquid casting material is discharged from the casting chamber 2 into the die cavity in the associated die-filling operation, i.e. the volume of casting material to be discharged is equal to the volume of the part of the casting piston 4 that has been moved into the casting chamber 2. As a maximum, the casting piston 4 can be moved forward as far as a position in which its front extreme end 4*c* reaches the inner wall of the casting chamber body 1 at the end face in which the casting material outlet 3 is located, the piston diameter d in this example being larger than a diameter a of the casting material outlet 3. It may alternatively be envisaged to choose the diameter a of the casting material outlet 3 to be larger than the piston diameter d. In this case, the casting piston 4 can be moved forward with its front extreme end 4*c* into the casting material outlet 3 if it is expedient to do so for the application concerned. The forward end position of the casting piston 4 may be defined here by the stroke of a conventional drive (not shown) for the casting piston 4 or by a corresponding limiting stop.

Casting material can be fed to the casting chamber 2 via a casting material feed line 7 and an associated casting material inlet 8, which has been made in a cylinder lateral surface of the hollow cylinder 1*a*. This has the consequence that the casting material inlet 8 opens out into the area of free space 6 of the casting chamber 2 in the form of an annular gap and, as a result, is not shut off by the moved-forward casting piston 4. The casting material inlet 8 and/or the casting material feed line 7 are provided with an actively or passively acting shut-off element 9, with which it is prevented that casting material located in the casting chamber can escape via the casting material inlet 8 when the casting piston 4 moves forward into the casting chamber 2. For example, the shut-off element 9 may be realized as schematically shown as a check valve.

For sealing the passage of the casting piston 4 through the through-passage 5, a sealing element 10, for example a sealing rubber or metal ring, is provided on an inner side of the through-passage 5 on the casting chamber side. The sealing element 10 is preferably designed such that under the pressure of the casting material in the casting chamber 2 it presses in a sealing manner against the casting piston 4 passed through, for example as an appropriately formed sealing lip element, and/or has been let or inserted into the through-passage 5. Depending on requirements, an elastic or non-elastic form of construction with a suitable geometry can be used for the sealing element 10.

For guiding the axially movable casting piston 4, a guiding sleeve 11 with a sleeve inner diameter corresponding to the piston diameter d is provided, realized in the example shown as an axial continuation or flange of the casting chamber body 1. At the same time, the guiding sleeve 11 in the exemplary embodiment shown serves for receiving a guiding sleeve temperature control device 12, which serves for active guiding sleeve temperature control and, as shown, may also extend axially into the region of the through-passage 5. The temperature control device 12 may also contribute to controlling the temperature of the casting piston 4 guided in the guiding sleeve 11. It may for example be of a type with a liquid or gaseous temperature control medium which is ducted through temperature control channels that coaxially surround the casting piston 4 in the corresponding portion of the guiding sleeve 11 or of the through-passage 5.

For the active casting piston temperature control there may be provided, as realized in the exemplary embodiment shown, a corresponding casting piston temperature control device 14, which in turn is for example of a type with a liquid or gaseous temperature control medium which is ducted through one or more temperature control channels 14*a* that extend in the casting piston 4 itself. In the exemplary embodiment shown, this is realized by a temperature control pipe 15 being inserted longitudinally centrally into an inner space 16 of the casting piston 4 realized for this purpose as a hollow cylinder, while leaving an annular gap between the temperature control pipe 15 and the inner wall of the casting piston. The annular gap represents a first temperature control channel, while the temperature control pipe 15 represents a second temperature control channel, it being possible for the temperature control medium to be made to pass via one of the two temperature control channels and into the front region of the casting piston and carried away again to the rear via the other temperature control channel.

For this purpose, the temperature control devices 12, 14 mentioned can be used for actively controlling the temperature of the casting piston 4 or the guiding sleeve 11 in the portion concerned, for example according to a predeterminable temperature profile, along at least part of its length that can be moved forward into the casting chamber. In particular, this makes it possible, depending on requirements and the application, to counteract the temperature influence of the hot molten casting material in the casting chamber 2 on the part of the casting piston 4 that can be moved into the casting chamber, for example for the purpose of not allowing excessive axial temperature gradients in the casting piston 4, which could hinder the sealing of the casting piston 4 at the through-passage 5 on account of locally differing expansion of the piston material. For this purpose, the two temperature control devices 12, 14 may be suitably coordinated with each other for a desired temperature control of the casting piston 4 and expediently also of the guiding sleeve 11, it also being possible in alternative embodiments for only one of the two temperature control devices 12, 14 to be provided.

Also provided is a casting chamber temperature control device 13, with which the temperature of the casting chamber 2 together with the casting material inlet 8 along with the adjacent casting material feed line 7 and casting material outlet 3 along with the adjacent casting material outlet line can be actively controlled in a desired way. For this purpose, this temperature control device 13 may also be for example of a type with a liquid or gaseous temperature control medium which is ducted through temperature control channels that coaxially surround the hollow cylinder 1*a* or the casting material feed line 7 and/or the casting material outlet line. With this temperature control device 13, it is consequently possible to keep the casting material at a comparatively constant temperature level without strong temperature gradients when, for the next casting operation respectively, it is ducted via the feed line 7 into the casting chamber 2, stored there and then discharged via the casting material outlet 3 in the die-filling operation. If need be, the temperature control device 13 may be divided into a number of separately controllable temperature control zones or temperature control units.

As already evident from the above description of the structural circumstances, in the case of the casting unit shown the casting piston 4 is intended as a pure displacement piston, the advancement of which into the casting chamber 2 determines the amount of molten material to be discharged from the casting chamber 2 into a die cavity, as usual under high speed and high pressure, the casting piston 4 moving freely into the casting chamber 2 without its lateral surface having to slide with its surface area along a cylinder inner wall of the casting chamber body 1. In the case of this casting unit of the displacement piston type, there are in principle no longer any disturbing frictional effects on a corresponding sliding surface between the casting piston and the casting chamber wall, as are inherent in the conventional casting units of the spool type.

Moreover, it is relatively easy to avoid air getting into the casting chamber 2 when the casting piston 4 moves back after a completed die-filling operation. This is so because the moved-forward casting piston 4 does not shut off the casting material inlet 8, so that, when the casting piston 4 moves back, the casting chamber 2 can be immediately replenished with casting material via the feed line 7 and the then opening shut-off element 9. This introduction of casting material takes place for example substantially without any pressure or with low positive pressure, and in any event the sucking in of air, for example via the casting material inlet 8, can be avoided if desired. Replenishing can moreover be improved by a closing plug that prevents air from being sucked in from the casting material outlet as a result of casting material solidifying toward the end of the respective casting cycle.

The displacement piston principle that is realized in the present case makes it easier to build up a high pressure and to move the casting piston 4 at high speed to bring about die filling, the then closed shut-off element 9 keeping the casting material inlet 8 closed, so that the casting material displaced by the casting piston 4 only leaves the casting chamber 3 to fill the die cavity via the casting material outlet 3. Furthermore, the casting piston configuration according to the invention has the advantage that no piston lubricant is required, and consequently no corresponding residues can occur in the casting produced.

FIGS. 2 to 5 illustrate various advantageous variants of the casting unit from FIG. 1, the same designations being used for elements that are identical or functionally equivalent for the purposes of easier understanding, and to this extent it is possible to refer to the above statements relating to the casting unit from FIG. 1.

Figure 2:
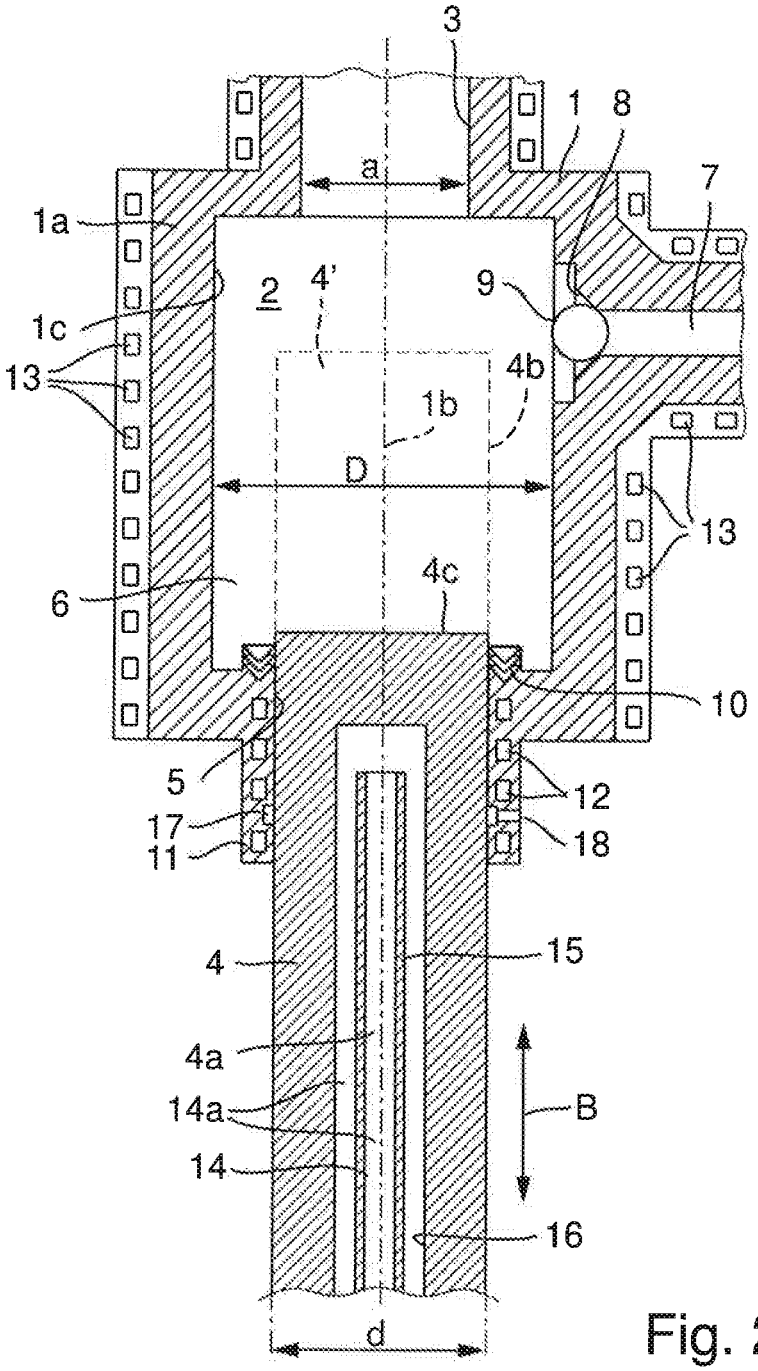
FIG. 2 shows a view corresponding to FIG. 1 for a variant of the casting unit with a relieving annular groove and relieving channel.

The casting unit shown in FIG. 2 has in addition to that from FIG. 1 a relieving annular groove 17 and an assigned relieving channel 18. In this example, the relieving annular groove 17 has been made in the form of a circular ring in the inner wall of the guiding sleeve 11, to be precise at an axial level between the through-passage 5 of the casting chamber body 1 and the axially outer extreme end of the guiding sleeve 11. The relieving channel 18 leads outward from the relieving annular groove 17, i.e. into the outer space outside the casting chamber 1, for which purpose the relieving channel 18 has been made for example as a radial bore through the wall of the guiding sleeve 11.

The relieving annular groove 17 forms together with the relieving channel 18 a system for carrying away leakage, in order to be able to discharge in a controlled manner any material, such as molten material, that possibly penetrates undesirably into the intermediate space between the casting piston 4 and the through-passage 5 or the guiding sleeve 11, for example on account of wear effects on the outer side of the casting piston 4, on the sealing element 10 and/or on the inner side of the through-passage 5 or of the guiding sleeve 11.

Figure 3:
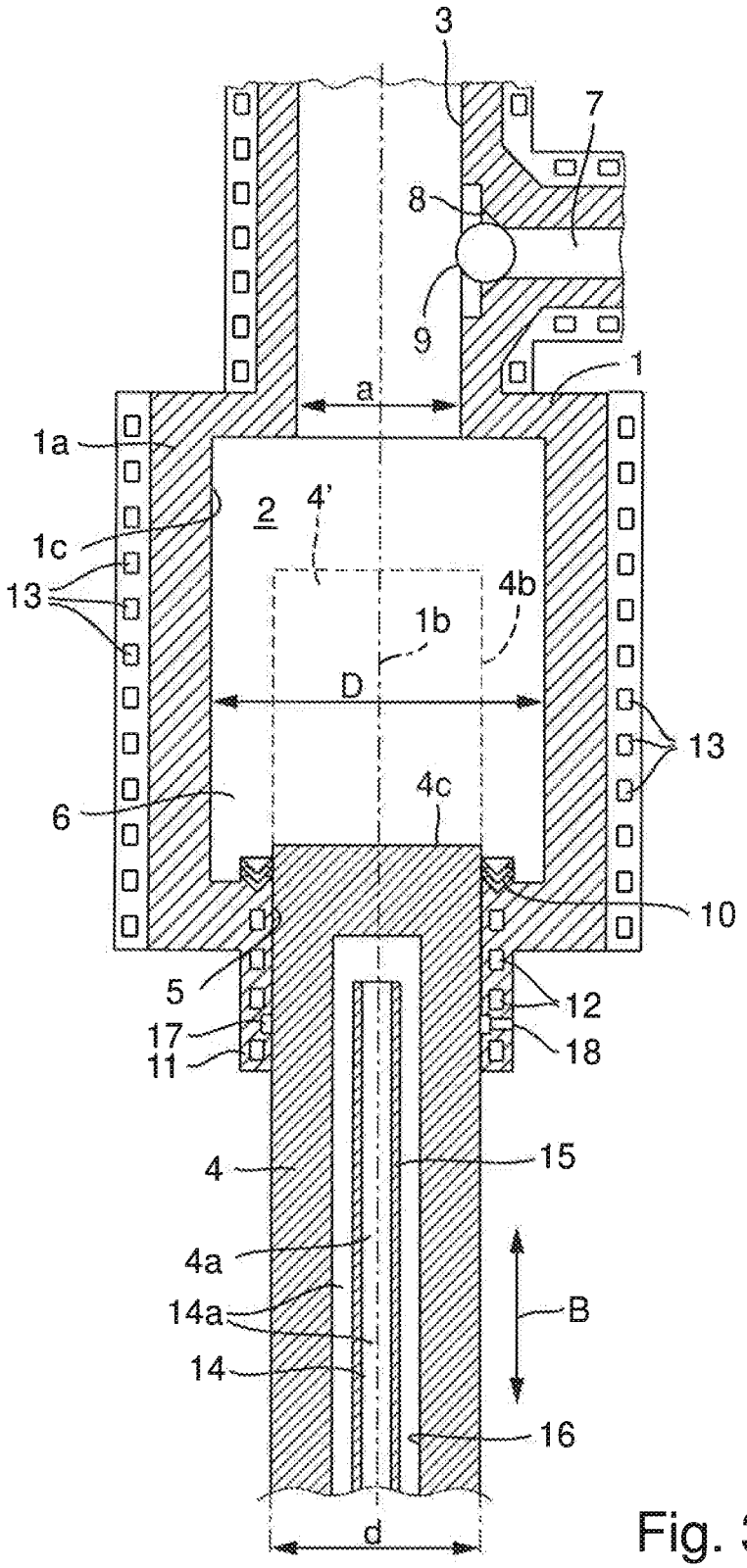
FIG. 3 shows a view corresponding to FIG. 2 for a variant of the casting unit in which a casting material inlet opens out into a casting material outlet region instead of an area of free space of the casting chamber.

The casting unit shown in FIG. 3 differs from that of FIGS. 1 and 2 in that the casting material inlet 8 does not open out into the area of free space 6, but into the region of the casting material outlet 3 of the casting chamber 2. This placement of the casting material inlet 8 also ensures that it is not shut off by the moved-forward casting piston 4. The properties and advantages explained above in relation to the exemplary embodiments of FIGS. 1 and 2 also apply otherwise in the same way to the casting unit from FIG. 3.

Figure 4:
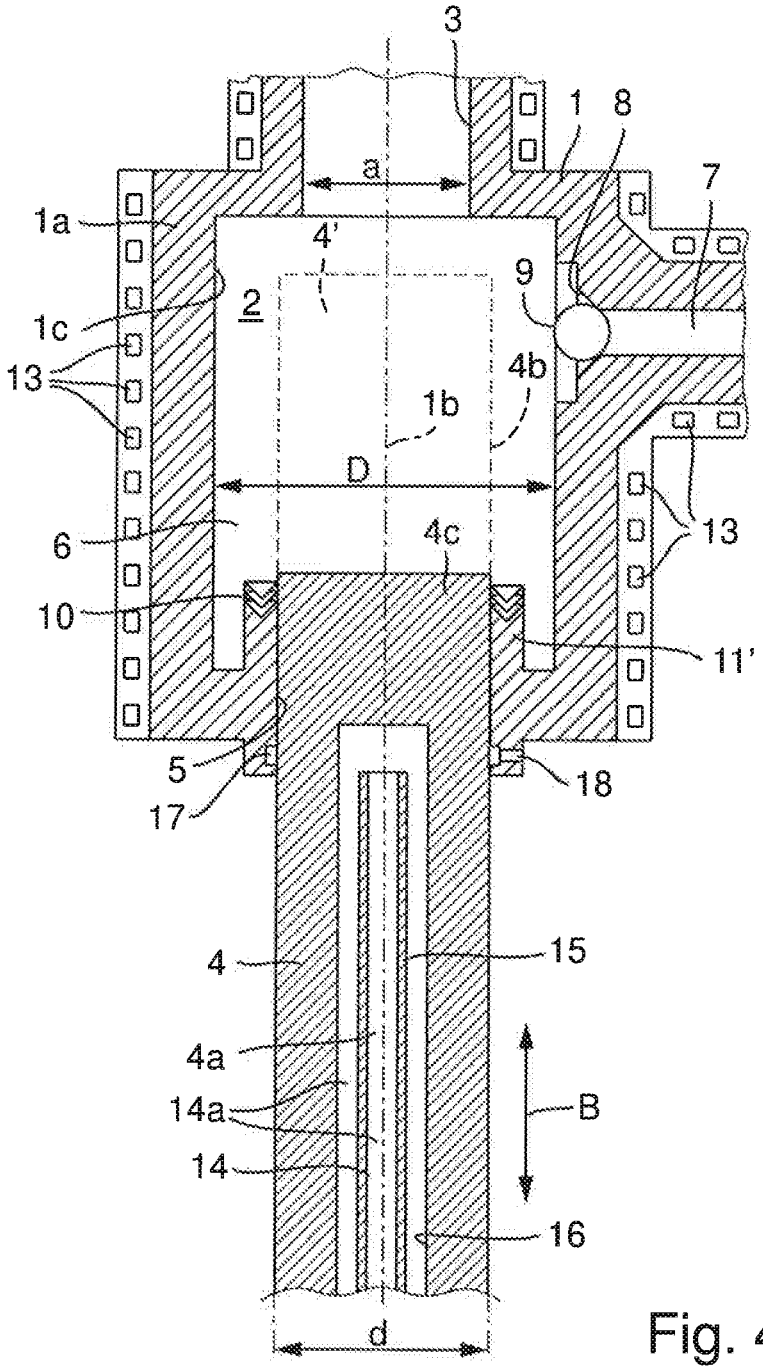
FIG. 4 shows a view corresponding to FIG. 2 for a variant of the casting unit with a casting piston guiding sleeve extending primarily into the casting chamber instead of outward from the casting chamber.

The casting unit shown in FIG. 4 differs from that of FIGS. 1 and 2 in that a guiding sleeve 11' is formed for the supported guidance of the casting piston 4, said sleeve extending in this case primarily into the casting chamber 2, i.e. with a predeterminable axial guiding sleeve length into the area of free space 6 remaining between the casting piston 4 and the casting chamber inner wall 1*c*. In this example, the sealing element 10 is arranged in the region of, or let into, the inner extreme end of this guiding sleeve 11'. The relieving annular groove 17 and the relieving channel 18, which also in the case of this variant of the casting unit may be optionally provided, are located in the region of a relatively short axial part of the guiding sleeve support of the casting piston 4 that is facing outward from the actual hollow cylinder 1*a* of the casting chamber.

Since in the case of this variant of an embodiment the predominant part of the guiding sleeve 11' is located in the casting chamber 2, and can therefore be heated during operation by the molten material present there, it is optionally possible to dispense with the guiding sleeve temperature control device 12 as shown in FIGS. 1 to 3.

Figure 5:
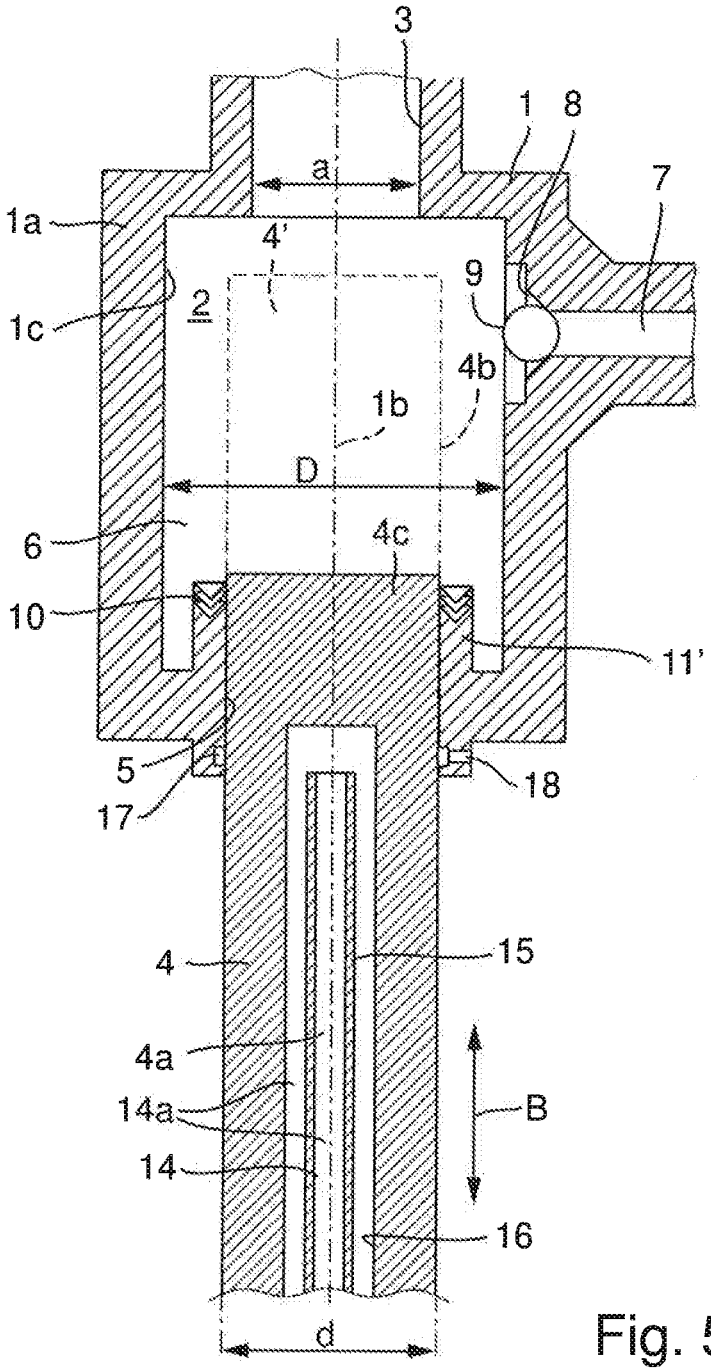
FIG. 5 shows a view corresponding to FIG. 4 for a variant of the casting unit without active casting chamber temperature control.

The casting unit shown in FIG. 5 corresponds to that from FIG. 4 with the exception that in this case the temperature control device 13 for active temperature control of the casting piston is not provided. This casting unit is suitable for example for applications that do not require active heating of the casting chamber 2. This variant can be used for example for cases in which the complete casting unit is immersed in a molten bath, so that the casting unit is heated passively by way of the hot molten material, i.e. the hot, liquid molten material surrounds the casting chamber 2 or the casting chamber body 1 and also heats it up from the outside. In addition, the molten material introduced into the casting chamber 2 from the molten bath via the casting material inlet 8 may keep the casting chamber 2 hot from the inside, as is also the case with the other exemplary embodiments shown.

It goes without saying that further variants of the casting unit according to the invention are possible, variants in which the various modifications mentioned in relation to the variants of FIGS. 2 to 5 are combined in some other way. Thus, for example, in all cases the relieving annular groove 17 with the relieving channel 18 is optionally present or not. At the same time, as an alternative to the circular configuration mentioned, the relieving annular groove 17 may for example also have a helically coiled shape. The opening of the casting material inlet 8 into a region of the casting material outlet 3, as it is shown in FIG. 3, may also be provided in the case of the variants of FIGS. 4 and 5. Moreover, in the case of the variant with a not actively heated casting chamber 2 according to FIG. 5, instead of the guiding sleeve 11' that is shown, facing primarily into the casting chamber 2, a primary outwardly facing guiding sleeve may be provided, like the guiding sleeve 11 in the case of the variants of FIGS. 1 to 3.

It also goes without saying that the invention is not restricted to the exemplary embodiments shown in the figures or mentioned above. Thus, in other exemplary embodiments of the invention, further modifications of it may be provided, for example a casting piston with a non-circular cross section and a correspondingly designed through-passage may be used, and/or the guiding sleeve may be realized as a component that is separate from the casting chamber body, possibly as a component mounted on said body. In further embodiments of the invention, the casting material inlet and the casting material outlet may be changed over with respect to their positions in the exemplary embodiment shown, or open out into the casting chamber at any other desired positions. The casting piston may in corresponding embodiments also extend into the casting chamber transversely in relation to the longitudinal direction of the casting material outlet and/or the casting material inlet. For each of the mentioned temperature control devices 12, 13, 14, not only the type of construction mentioned but also any other type with which a person skilled in the art is familiar for this application can be used, in the case of a heating device for example also an electrical heating device with electrical heating elements.

In the examples shown, the area of free space is formed as an annular gap that is continuous in the circumferential direction, i.e. the casting piston moves freely in the casting chamber 3 without support. In alternative embodiments, punctiform or linear guidance of the casting piston within the casting chamber may be provided, i.e. in such exemplary embodiments the casting piston comes to lie with an outer lateral surface along one or more line contacts and/or along one or more point contacts against a delimiting wall of the casting chamber that is transversely opposite from the direction of movement of the casting piston. In these cases, although there is still a certain amount of friction between the casting piston and a casting chamber delimiting wall, the fact that there is only a one-dimensional line contact or a zero-dimensional point contact means that it is less than in the conventional case of the spool type, in which the outer lateral surface of the casting piston lies against the opposing casting chamber wall over the full surface area of a two-dimensional frictional contact area. Thus, the exemplary embodiment shown could be modified in the sense of a line contact, for example to the extent that the inner wall 1*c* of the hollow cylinder or the outer lateral surface 4*b* of the casting piston is provided with guiding ridges which are arranged distributed around the circumference, extend with an axial directional component and keep the casting piston 4 guided within the casting chamber 2 in its axial movement. These guiding ridges then divide the free space of the annular gap 6 into a number of corresponding segments.

The invention claimed is:

1. A casting unit for a diecasting machine, comprising:

a casting chamber body including a casting chamber which is capable of being filled with casting material and comprises a casting material inlet and a casting material outlet; and a casting piston, capable of being moved forward in a longitudinal direction of the casting piston in the casting chamber, in order to discharge casting material from the casting chamber under pressure via the casting material outlet, and moved backward, in order to feed casting material into the casting chamber via the casting material inlet, and at least one of: (i) a casting piston temperature control device configured to actively independently control the temperature of the casting piston, at least in certain regions, or (ii) a guiding sleeve temperature control device configured to actively independently control the temperature of a guiding sleeve for the casting piston, wherein the casting piston extends through a through-passage of the casting chamber body from outside into the casting chamber, an area of free space of the casting chamber being formed between an outer lateral surface of the casting piston moved forward into the casting chamber and an inner wall surface of the casting chamber body lying opposite said outer lateral surface transversely in relation to the longitudinal direction of the casting piston, by an outer cross section of the casting piston being appropriately smaller than an inner cross section of the casting chamber body.

2. The casting unit as claimed in claim 1, wherein the casting material inlet opens out into at least one of the area of free space and into the casting material outlet.

3. The casting unit as claimed in claim 2, wherein at least one of the casting material inlet and a casting material feed line assigned to the casting material inlet is provided with a shut-off element, which prevents casting material from escaping from the casting chamber via the casting material inlet.

4. The casting unit as claimed in claim 1, wherein the casting chamber body has a hollow cylinder and the through-passage is provided at an extreme end of the hollow cylinder.

5. The casting unit as claimed in claim 4, wherein at least one of the casting material outlet and the casting material inlet is provided at an extreme end of the hollow cylinder that is opposite from the through-passage or on a cylinder lateral surface of the hollow cylinder.

6. The casting unit as claimed in claim 3, wherein the casting chamber body has a hollow cylinder and the through-passage is provided at an extreme end of the hollow cylinder.

7. The casting unit as claimed in claim 6, wherein at least one of the casting material outlet and the casting material inlet is provided at an extreme end of the hollow cylinder that is opposite from the through-passage or on a cylinder lateral surface of the hollow cylinder.

8. The casting unit as claimed in claim 1, wherein the guiding sleeve is provided for the casting piston, said guiding sleeve extending at least one of:

(i) outward from an outer side of the through-passage that is facing away from the casting chamber, and (ii) inward from an inner side of the through-passage that is facing the casting chamber into the casting chamber.

9. The casting unit as claimed in claim 2, wherein the guiding sleeve is provided for the casting piston, said guiding sleeve extending at least one of:

(i) outward from an outer side of the through-passage that is facing away from the casting chamber, and (ii) inward from an inner side of the through-passage that is facing the casting chamber into the casting chamber.

10. The casting unit as claimed in claim 4, wherein the guiding sleeve is provided for the casting piston, said guiding sleeve extending at least one of:

(i) outward from an outer side of the through-passage that is facing away from the casting chamber, and (ii) inward from an inner side of the through-passage that is facing the casting chamber into the casting chamber.

11. The casting unit as claimed in claim 7, wherein the guiding sleeve is provided for the casting piston, said guiding sleeve extending at least one of:

(i) outward from an outer side of the through-passage that is facing away from the casting chamber, and (ii) inward from an inner side of the through-passage that is facing the casting chamber into the casting chamber.

12. The casting unit as claimed in claim 11, wherein a sealing element for sealing off the casting piston passage is provided.

13. The casting unit as claimed in claim 1, wherein a sealing element for sealing off the casting piston passage is provided.

14. The casting unit as claimed in claim 1, wherein the temperature control device is configured to allow the temperature of the casting piston to be actively controlled according to a predeterminable temperature profile along at least a part of its length which is moved forward into the casting chamber.

15. The casting unit as claimed in claim 12, wherein the temperature control device is configured to allow the temperature of the casting piston to be actively controlled according to a predeterminable temperature profile along at least a part of its length which is moved forward into the casting chamber.

16. The casting unit as claimed in claim 15, wherein a casting chamber temperature control device for actively controlling the temperature of the casting chamber is provided.

17. The casting unit as claimed in claim 1, wherein a relieving annular groove is provided on an inner wall of the through-passage or the guiding sleeve that is facing the casting piston and a relieving channel leading from the relieving annular groove to the outer side of the casting chamber body is provided.

18. A casting unit for a diecasting machine, comprising:

a casting chamber body including a casting chamber which is capable of being filled with casting material and comprises a casting material inlet and a casting material outlet; and a casting piston, capable of being moved forward in a longitudinal direction of the casting piston in the casting chamber, in order to discharge casting material from the casting chamber under pressure via the casting material outlet, and moved backward, in order to feed casting material into the casting chamber via the casting material inlet, wherein the casting piston extends through a through-passage of the casting chamber body from outside into the casting chamber, an area of free space of the casting chamber being formed between an outer lateral surface of the casting piston moved forward into the casting chamber and an inner wall surface of the casting chamber body lying opposite said outer lateral surface transversely in relation to the longitudinal direction of the casting piston, by an outer cross section of the casting piston being appropriately smaller than an inner cross section of the casting chamber body, and wherein a sealing element is arranged to seal off the through-passage, the scaling element being stationarily located with respect to a casting chamber side of the through-passage such that, under pressure of the casting material in the casting chamber, the sealing element is pressed in a sealing manner against the casting piston passed through the through-passage.

19. A casting unit for a diecasting machine, comprising:

a casting chamber body including a casting chamber which is capable of being filled with casting material and comprises a casting material inlet and a casting material outlet; and a casting piston, capable of being moved forward in a longitudinal direction of the casting piston in the casting chamber, in order to discharge casting material from the casting chamber under pressure via the casting material outlet, and moved backward, in order to feed casting material into the casting chamber via the casting material inlet, wherein the casting piston extends through a through-passage of the casting chamber body from outside into the casting chamber, an area of free space of the casting chamber being formed between an outer lateral surface of the casting piston moved forward into the casting chamber and an inner wall surface of the casting chamber body lying opposite said outer lateral surface transversely in relation to the longitudinal direction of the casting piston, by an outer cross section of the casting piston being appropriately smaller than an inner cross section of the casting chamber body, wherein the casting piston portion that moves into the casting chamber has a constant outer cross-section, and wherein the casting piston, in a rear end position of the casting piston, extends up to the free space of the casting chamber.

20. The casting unit as claimed in claim 1, further comprising a casting chamber temperature control device configured to actively independently control the temperature of the casting chamber.

* * * * *